US006269741B1

(12) United States Patent
Young

(10) Patent No.: US 6,269,741 B1
(45) Date of Patent: Aug. 7, 2001

(54) FILTER SYSTEM FOR OLIVE OIL RECOVERY

(76) Inventor: William M. Young, 26880 St. Francis Rd., Los Altos Hills, CA (US) 94022

( * ) Notice: Subject to any disclaimer, the term of this patent is extended or adjusted under 35 U.S.C. 154(b) by 0 days.

(21) Appl. No.: 09/475,621

(22) Filed: Dec. 30, 1999

(51) Int. Cl.[7] ..... B30B 9/06

(52) U.S. Cl. ..... 100/113; 100/122; 100/126; 99/495

(58) Field of Search ..... 99/495, 506–508; 426/489; 100/110, 113, 119, 122, 126

(56) References Cited

U.S. PATENT DOCUMENTS

| | | | | |
|---|---|---|---|---|
| 63,096 | * | 3/1867 | Phillilps . | |
| 219,217 | * | 9/1879 | Campbell . | |
| 298,848 | * | 5/1884 | Hamilton . | |
| 316,874 | * | 4/1885 | Brown . | |
| 320,442 | * | 6/1885 | Oliver . | |
| 368,056 | * | 8/1887 | Boschert . | |
| 461,129 | * | 10/1891 | Leechman . | |
| 734,917 | * | 7/1903 | Marshall . | |
| 785,681 | * | 3/1905 | O'Brien . | |
| 815,291 | * | 3/1906 | Haskell et al. . | |
| 870,512 | * | 11/1907 | Hershiser . | |
| 1,107,487 | * | 8/1914 | Brown . | |
| 1,201,978 | * | 10/1916 | Mixer . | |
| 1,247,947 | * | 11/1917 | Pouthat et al. . | |
| 1,500,124 | * | 7/1924 | Hale . | |
| 1,504,450 | * | 8/1924 | Henry . | |
| 1,798,555 | * | 3/1931 | Pipin . | |
| 4,234,615 | * | 11/1980 | Krueger | 426/478 |
| 4,522,119 | | 6/1985 | Finch et al. | 99/483 |
| 5,045,186 | * | 9/1991 | Takashima | 210/90 |
| 5,752,434 | * | 5/1998 | Kuan | 99/495 |
| 5,791,237 | * | 8/1998 | Gibson | 99/510 |

OTHER PUBLICATIONS

EREDI Francesco Bruno Product Information—2 pages Commerical Filter Mats For Olive Oil Recovery—Enclosed Copy.

* cited by examiner

*Primary Examiner*—Keith Hendricks
*Assistant Examiner*—Drew Becker

(57) ABSTRACT

Olive or other fruit paste from which oil is to be recovered is spread upon and sandwiched between two filter mats which are in turn sandwiched between two filter plates. Filter plates have slots extending from within the plate to the outer edges. Additional layers of paste between filter mats and a filter plate between each layer may be added to form a stack which is then placed on a press. As pressure is applied, juice containing the oil to be recovered flows out of the paste, through the filter mats and out of the stack through the conduits formed by the slots in the filter plates. By providing conduits, flow length and flow resistance is dramatically reduced resulting in more efficient and faster juice extraction. Filter mats can be economically fabricated to any size or shape, have selectable flow rates to match the properties of a particular paste, can be repeatedly reused, and can be washed at the end of the season for storage.

3 Claims, 2 Drawing Sheets

FILTER SYSTEM FOR OLIVE OIL RECOVERY

BACKGROUND

1. Field of Invention

This invention relates to the recovery of olive oil, specifically, to an improved filter system to extract juice containing oil from olive and other fruit pastes.

2. Description of Prior Art

In the production of olive or other fruit oil the first step is to mill or grind the fruit into a paste. In the case of olives the pits are ground into the paste. The second step is to agitate and warm the paste if necessary to increase oil release. The third step is to extract the juice which includes the oil from the paste. The fourth step is to separate the oil from the juice.

This invention addresses the third step of extracting the juice containing oil from the paste. In the earliest method employed the paste was placed in a porous bag and pressed by any available means to express the juice. One of the present methods employed is to first spread the paste on specially made round mats which are then placed one on top of the other to form a stack. The stack is then placed between the stationary and moveable platens of a press and subjected to an axial force. The force exerted creates an internal pressure in the paste causing the juice to flow radially outward to the edges of the mat where it then flows down into a container provided at the base of the stack. A relatively dry residue or pomace remains on the mats.

Current mats are woven from various materials such as cord and yarn to form a semi rigid circular shape. They are available in various diameters up to about 80 centimeters, have an approximately 8–22 centimeter diameter hole in the center, and are approximately 7 millimeters thick. Due to the method of construction a center hole is required to fabricate these mats, but is not functionally necessary in the extraction process. They are relatively expensive and being foreign made are not readily available, particularly in a small size that would be suitable for use in a small homeowner or experimental press. Cleaning these mats after a seasons use is difficult because they retain a considerable amount of oil due to their thickness and construction. If not thoroughly cleaned they must either be stored in a freezer to prevent the trapped oil from going rancid, or discarded.

Paste must be applied in a controlled amount and at a distance in from the edges to prevent the paste from overflowing when pressed. Since mats of different mesh size or flow rate are not available, the amount of paste applied must be continuously changed depending on the viscosity of the paste which varies with fruit variety and ripeness. As the juice flows radially outward to the edge of the mat the length that it must flow can be as long as the radius of the mat. Due to the method of construction current mats do not have radial conduits for the juice to flow through thereby, resulting is slow, restricted flow. In the case of olives some of the juice also flows through the paste itself through small conduits formed by the crushed pits. Such a long and restricted flow is inefficient, requiring an hour or more and sometimes multiple pressings to completely extract the juice.

OBJECTS AND ADVANTAGES

It is a general object of this invention to provide an improved filter system for extracting juice containing oil from olive or other fruit pastes. Additional objects and advantages are:

a) To reduce pressing time and make the extraction process more efficient by providing a shorter and less restricted flow length.

b) To provide reusable filter mats of various mesh size and flow rate to accommodate fruit pastes with different characteristics and viscosities.

c) To provide a filter mat that can easily be made to any size or shape and is economical to manufacture.

d) To provide a filter system that can be easily cleaned at the end of the season for storage and future use.

Further objects and advantages of my invention will become more apparent from following description read in conjunction with the drawings.

DRAWING FIGURES

REFERENCE NUMERALS IN DRAWINGS

10 Filter Mat
12 Filter Plate
14 Fruit Paste
16 Slots
18 Grooves
20 Press
22 Stationary Platen of Press
24 Moveable Platen of Press
26 Juice Container
28 Actuator

DESCRIPTION FIGS. 1–3

Figure 1:
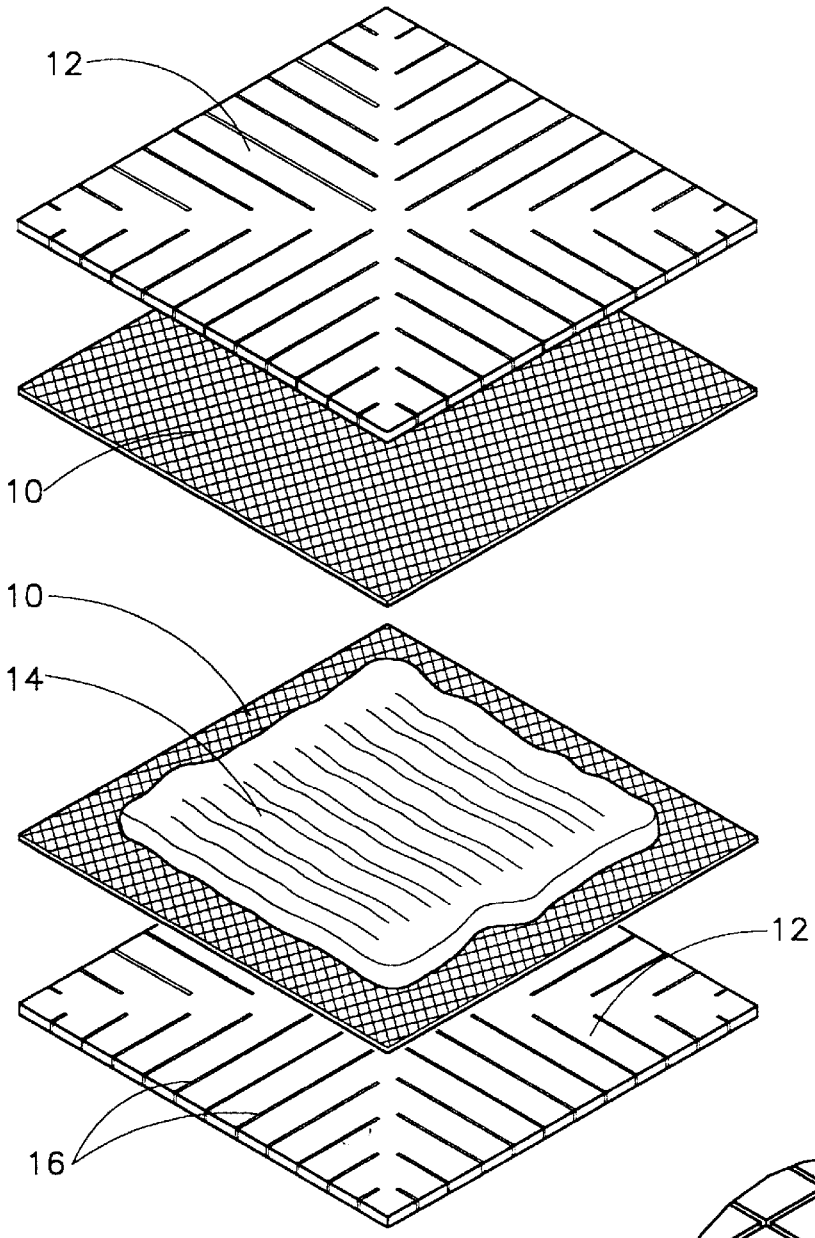
FIG. 1 is an exploded isometric drawing showing the principle elements of the invention.

FIG. 1 is an exploded view showing the basic elements of the invention where fruit paste 14 is sandwiched between filter mats 10. This assembly is in turn sandwiched between filter plates 12. Filter mats 10 may be of any size or shape, a square shape being illustrated. Filter plates 12 are essentially the same size and shape as filter mats 10.

Filter mat 10 is fabricated from a suitable fabric that is chemically resistant to fruit paste 14, has sufficient strength and durability, and the proper flow rate. Filter mat 10 material is selected with a modulus of elasticity and tensile strength sufficient to allow filter mat 10 to bridge the width of slot 16 and not be forced into it under the internal pressure developed when pressed. Flow rate as determined by weave, mesh, yarn size, etc., must be sufficient to allow the fruit juice and oil to flow through while excluding the ground meat, skin and pits. Synthetic filter fabric is the preferred material as it is chemically resistant , has good physical properties, and can be easily cut to any size or shape. Edges of this material can be heat sealed which melts or fuses the edge fibers thus preventing the fabric from unraveling. Filter mats of this material can be repeatedly hand or machine washed and reused many times. Filter fabric is available in various flow rates allowing the selection of one to match the characteristics and viscosity of the paste. Proper selection results in a liquid with fewer solid particles while at the same time preventing the paste from overflowing out the edge of the stack under pressure.

Figure 2:
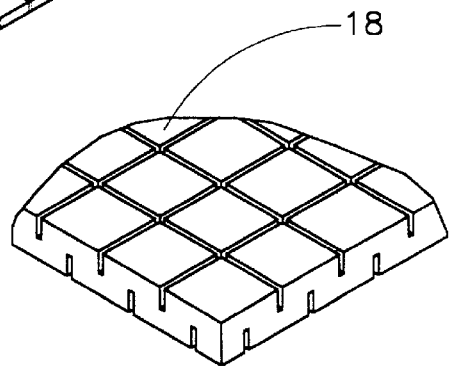
FIG. 2 illustrates an alternate slot construction.

Filter plate 12 is made from tough chemically resistant plastic such as polyethylene. The slots 16 extend from within the plate to the outer edge. Their purpose is to provide an unrestricted conduit for the juice and oil to flow out of paste 14 as it is pressed. Slots 16 extend completely through the thickness of filter plate 12 and are arranged so as to retain the structural integrity of the plate. FIG. 2 illustrates an alternate method of providing fluid conduits using grooves in place of slots. In this figure, grooves 18 are located on both sides of plate 12 and extend to a depth less than the thickness of plate 12. Grooves 18 may be used together with or in place of slots 16. Grooves 18 extend from within filter plate 12 to the outer edge, and are arranged so as to cross or intersect other grooves thus forming multiple flow conduits. A square pattern with intersecting grooves is illustrated.

The width of slots 16 or grooves 18 are narrow enough to prevent filter mat 10 from being forced into slot 16 or groove 18 under pressure yet wide enough to provide a conduit with minimum flow restriction. Spacing between slots 16 or grooves 18 determine the distance or flow length that the juice and oil must flow through paste 14 and filter mat 10 to reach a conduit. Flow length in turn determines the time required for the juice and oil to completely flow out of paste 14. To reduce pressing time, therefore, slots 16 or grooves 18 are spaced at a minimum practical distance to provide the shortest flow length. Compared to the previously described mats currently in in use that do not have radial slots or grooves or other fluid conduits the flow length is, therefore, dramatically reduced.

It is to be understood that the slot and groove conduits shown on the filter plates are for illustration only as there are other ways that suitable conduits can be formed. The basic requirement is that the filter plate have a plurality of conduits that permit the juice from the paste to flow with minimum restriction from within the area covered by the paste to the outer edges of the filter plates.

Operation

Figure 3:
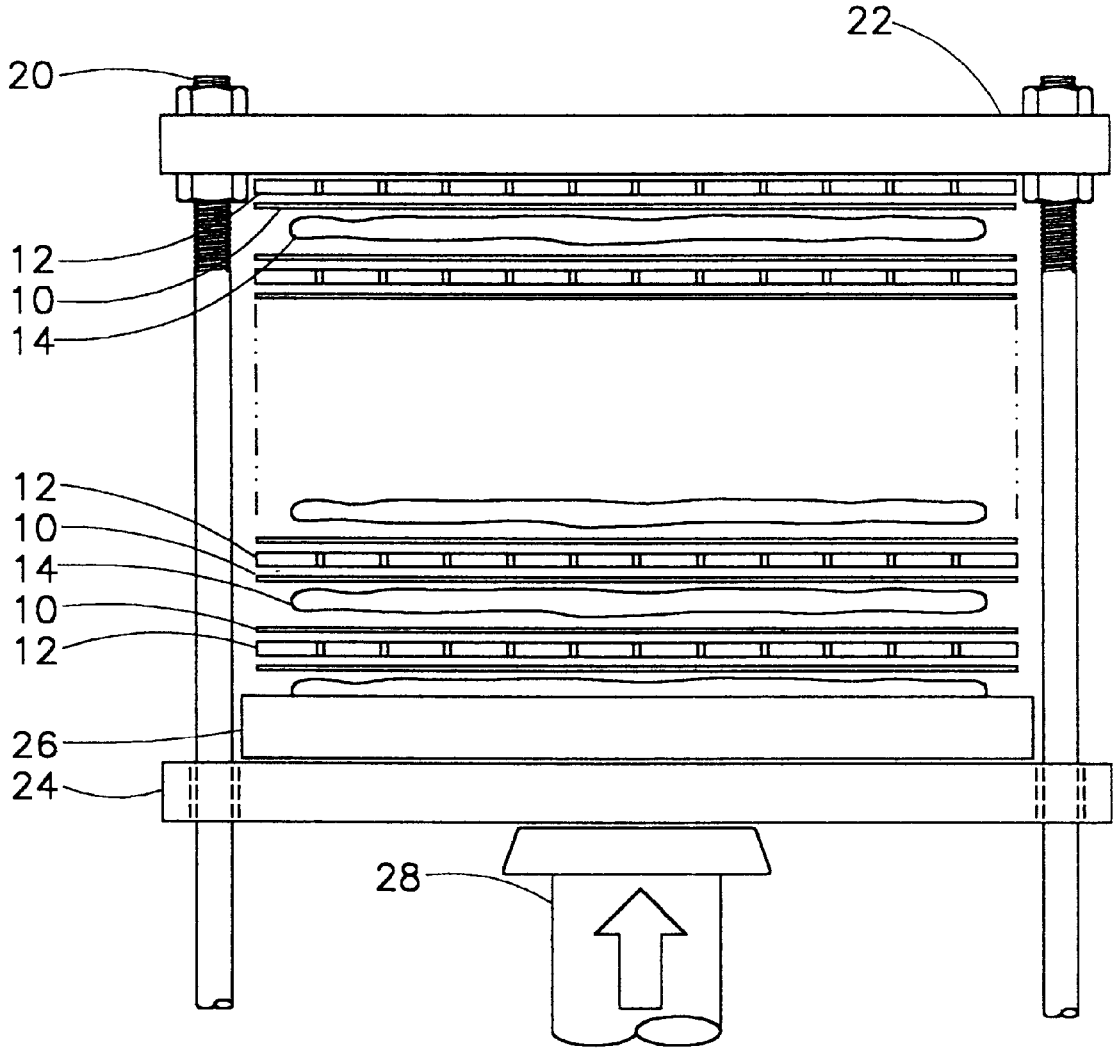
FIG. 3 shows a plurality of filter elements stacked on a press for juice extraction.

Referring to FIG. 3, a filter plate 12 is first placed in juice container 28. A filter mat 10 is then placed on top of filter plate 12. A measured amount of fruit paste 14 is then evenly spread on filter pad 10 to within a predetermined distance from the edges of filter mat 10. Another filter mat 10 is placed on fruit paste 14 followed by a filter plate 12 and another filter mat 10. Fruit paste 14 is applied as before and the procedure repeated until a stack of the desired number of layers is formed. Juice container 26 together with the formed stack is then placed on moveable platen of press 20. Press 20 may be hydraulically actuated or of any available type with sufficient capacity. As force is applied by actuator 28 moveable platen 24 raises the stack up against stationary platen 22 creating an internal pressure in fruit paste 14. As pressure is increased juice and oil flows from fruit paste 14 through filter mats 10 into conduits formed by slots 16 or grooves 18 in filter plates 12. Fruit juice containing oil flows through the conduits outward to the edge of the stack and down into container 26. When pressing is completed only a relatively dry residue or pomace remains on filter matsi 0. This pomace is easily and completely removed by flexing or shaking filter mat 10. Filter mats 10 and filter plates 12 can then be immediately and continuously reused, and finally, machine washed and stored at the end of the season.

Conclusions

A filter system for extracting juice containing oil from olives and other fruit has been presented that offers important new features and advantages.

- Significantly less flow restriction and a shorter fluid flow length resulting in faster, more efficient juice and oil extraction.
- Filter mats with different flow rates to accommodate fruit pastes with different characteristics and viscosities.
- A filter system that can be economically and easily made to any size or shape.
- A durable, reusable filter system that can be hand or machine washed at the end of the season for storage and future use.

Although a specific embodiment of this invention has been shown and described, it will be understood that it is merely illustrative and that various modifications may be made therein without departing from the scope and spirit of this invention. For example, the two filter mats illustrated could be made as one piece in the form of a pocket with an opening provided for filling the pocket.

What is claimed is:

1. A filter system to extract juice containing oil from olives or other fruit pastes comprising a fruit paste, two fabric filter mats between which said fruit paste is spread and sandwiched, two filter plates between which said fabric filter mats and paste are sandwiched, said filter plates being of approximately the same size and shape as said fabric filter mats, said fabric filter mats having a porosity sufficient to allow the passage of said juice from said paste while excluding the solid materials contained within said paste, said filter plates having a conduit means comprising a plurality of slots, said slots having a depth equal to the thickness of said filter plate, said slots extending from within said filter plate to the outer edges of said filter plate, said slots being arranged so as to retain the structural integrity of said filter plate, a press means capable of raising the pressure within said fruit paste, whereby said fruit juice from said fruit paste flows through said fabric filter mats into said conduit means to the outer edges of said filter plates wherein the width of said slots and the thickness of said filter plate is selected to allow said fabric filter mat to bridge said slot under the pressure developed to form conduits for said fruit juice to flow to the outer edges of said filter plate.

2. The filter system of claim 1 wherein said fabric filter mat is fabricated from a synthetic filter fabric, said filter fabric having a selectable texture and flow rate to match the characteristics and viscosity of said fruit paste, said filter fabric having sufficient strength to bridge said slots under the pressure developed to form fluid conduits for said fruit juice to flow to the outer edges of said filter plate.

3. The filter system of claim 1 wherein multiple layers of fruit paste, fabric filter mats, and filter plates are stacked vertically, one upon the other, the order of said stack being filter plate, filter mat, paste, filter mat, filter plate, filter mat, paste, etc., this sequence being repeated to form a stack of the desired number of layers.

* * * * *